US006917044B2

(12) United States Patent
Amini

(10) Patent No.: US 6,917,044 B2
(45) Date of Patent: Jul. 12, 2005

(54) HIGH POWER HIGH YIELD TARGET FOR PRODUCTION OF ALL RADIOISOTOPES FOR POSITRON EMISSION TOMOGRAPHY

(76) Inventor: Behrouz Amini, Micro-Fission Technology, P.O. Box 32033, Knoxville, TN (US) 37930

( * ) Notice: Subject to any disclaimer, the term of this patent is extended or adjusted under 35 U.S.C. 154(b) by 492 days.

(21) Appl. No.: 10/036,240

(22) Filed: Jan. 3, 2002

(65) Prior Publication Data

US 2005/0061994 A1 Mar. 24, 2005

Related U.S. Application Data

(60) Provisional application No. 60/253,544, filed on Nov. 28, 2000.

(51) Int. Cl.[7] ..... G21G 1/00

(52) U.S. Cl. ..... 250/492.1; 376/195; 376/194; 376/245; 376/156

(58) Field of Search ..... 250/492.1; 376/195, 376/194, 245, 156

(56) References Cited

U.S. PATENT DOCUMENTS 6,011,825 A * 1/2000 Welch et al. ..... 376/195

OTHER PUBLICATIONS

Fujimoto et al., "Radioisotope Generating Apparatus", Pub. No. US 2002/0106046 A1, publication date: Aug. 8, 2002.*

Wieland et al., "Recirculating Target and Method for Producing Radionuclide", Pub. No. US 2004/0013219 A1, publication date: Jan. 22, 2004.*

* cited by examiner

*Primary Examiner*—John R. Lee
*Assistant Examiner*—Zia R. Hashmi

(57) ABSTRACT

A high power high yield target for the positron emission tomography applications is introduced. For production of Curie level of Fluorine-18 isotope from a beam of proton it uses about one tenth of Oxygen-18 water compared to a conventional water target. The target is also configured to be used for production of all other radioisotopes that are used for positron emission tomography. When the target functions as a water target the material sample being oxygen-18 or oxygen-16 water is heated to steam prior to irradiation using heating elements that are housed in the target body. The material sample is kept in steam phase during the irradiation and cooled to liquid phase after irradiation. To keep the material sample in steam phase a microprocessor monitoring the target temperature manipulates the flow of coolant in the cooling section that is attached to the target and the status of the heaters and air blowers mounted adjacent to the target. When the target functions as a gas target the generated heat from the beam is removed from the target by air blowers and the cooling section. The rupture point of the target window is increased by a factor of two or higher by one thin wire or two parallel thin wires welded at the end of a small hollow tube which is held against the target window. One or two coils are used to produce a magnetic filed along the beam path for preventing the density depression along the beam path and suppression of other instabilities that can develop in a high power target.

15 Claims, 2 Drawing Sheets

HIGH POWER HIGH YIELD TARGET FOR PRODUCTION OF ALL RADIOISOTOPES FOR POSITRON EMISSION TOMOGRAPHY

This non-provisional application is a continuation of a previously filed provisional application with application No. 60/253,544 and the filing date Nov. 28, 2000.

CROSS-REFERENCE TO RELATED APPLICATION

Not Applicable.

REFERENCE TO A MICROFICHE APPENDIX

Not Applicable.

FEDERALLY SPONSORED RESEARCH OR DEVELOPMENT

Not Applicable.

BACKGROUND OF THE INVENTION

The present invention relates generally to the production of radioisotopes and more specifically to a target comprising of a target body and a material sample confined in the target body to be irradiated by a beam of charged particles for producing a radioisotope.

A radioisotope may be produced based on various nuclear reactions by irradiating a material sample with a particle beam produced in an accelerator. A typical medical application is Positron Emission Tomography (PET). The nuclear medicine PET procedure is used for imaging and measuring physiologic processes within the human body. A radiopharmaceutical is labeled with a radioactive isotope and is suitably administered to a patient. The radioisotope decays inside the patient through the emission of positrons. The positrons are annihilated upon encountering electrons which produce oppositely directed gamma rays. A PET scanner includes detectors surrounding the patient which detect the paths of gamma rays. This data is suitably analyzed to map the presence of the radioisotopes in the patient for diagnostic purposes.

The commonly used radioisotopes for PET procedure are Fluorine-18 ($^{18}F$), Oxygen-15 ($^{15}O$), Nitrogen-13 ($^{13}N$) and Carbone-11 ($^{11}C$). The most common method of producing these isotopes is by irradiating their respected material samples by a beam of energetic proton. The material sample during the irradiation is confined in a target which comprises of a cavity for holding the sample and a thin foil at the entrance of the cavity to confine the sample. The irradiating beam passes through the thin foil and reaches the material sample. With a beam of proton the material samples to be irradiated are Oxygen-18 water for production of Fluorine-18, Nitrogen-15 gas for production of Oxygen-15, Oxygen-16 water for production of Nitrogen-13, and Nitrogen-14 gas for production of Carbon-11. The irradiating proton energy ranges from about 9 MeV to up to 18 MeV. Production of the above four radioisotopes requires four designated targets, one target for each radioisotope. The targets that uses Oxygen-18 and Oxygen-16 water as material samples are commonly referred to as the water targets and the other two that uses gas as material samples are referred to as the gas targets.

It is highly desirable to produce all four PET isotopes in a single target. This reduces the cost of building and maintaining four targets to one single target. One of the object of the prevent invention is to produce all four PET isotopes in one single target.

Fluorine-18 is the most widely used radioisotope for PET application. It has a half-life of less than two hours. Accordingly, the radioisotope must be produced daily before being administered to the patient. The material sample of this radioisotope, Oxygen-18 water, is very expensive and there is also a shortage of Oxygen-18 water world wide. Accordingly, it is desired to produce a large quantity of this radioisotope with as little of Oxygen-18 water as possible. This could be achieved by increasing the proton beam current bombarding the target. However, as the proton beam current increases the existing water targets suffer from many undesirable problems. These problems stem from the poor heat conductivity of water which cannot transfer the absorbed heat from the beam to the target body. Boiling, which is the reaction of water to excess heat and a means of transferring heat to the target body causes bubbles or the so called voids to be formed along the beam path. Subsequently the target becomes thin if the target depth, which is by definition the length of the water column as seen by the beam, is not already overcompensated. In a thin target the beam strikes the back of the target before losing its energy in water. The results are poor yield in addition to harmful sputtering of the target body material in the water which can be followed with unwanted nuclear reactions with beam and stable chemical reactions with fluoride ions. For production of Curie level of Fluorine-18 the costly method of dealing with the above problems has been to increase the depth of the target up to ten times the proton range in water. A target with this large depth defeats the primary consideration in design which is to consume as little of the expensive Oxygen-18 water as possible.

Accordingly, it is highly desired to provide a target which is configured for high proton beam current that can also use very little of expensive Oxygen-18 water for production of Curie levels of $^{18}F$ radioisotope. The other object of the present invention is to reduce the consumption of Oxygen-18 water for production of a given amount of Flourine-18 to about one tenth of a conventional water target. Additional object of the present invention is to eliminate all the noted problems of a water target. Further object of the present invention is to make the target suitable for accepting a high power beam.

Furthermore, it is well known that all gas targets develop density depression when irradiated with a moderate or high power beam. The density depression develops in the interaction volume—the volume that the beam interacts with the sample to produce an isotope. The density depression causes poor yield and also causes the beam to strike the back of the target body. Moreover, because of the density depression the target can become unstable. The problems noted here are not limited to a gas target. They should also occur in a steam target.

Accordingly, it is also highly desirable to prevent the density depression in a gas and a stream target and to suppress other instabilities which can develop in the target as the beam power increases. It is further the object of the present invention to prevent the density depression in gas and steam targets and suppress other instabilities that can develop as the beam power increases.

SUMMARY OF THE INVENTION

A high power high yield target uses a small amount of Oxygen-18 water to produce Curie level of fluorine-18 radioisotope from a beam of proton. The target is also configured to be used for production of all other radioisotopes that are used for positron emission tomography. When the target functions as a water target the material sample being oxygen-18 water or oxygen-16 water is heated to steam prior to irradiation using heating elements that are housed in the target body. The material sample is kept in steam phase during the irradiation and cooled to liquid phase after irradiation for unloading and recovering the radioisotopes. To keep the material sample in steam phase a microprocessor monitoring the target temperature manipulates the flow of coolant in the cooling section that is attached to the target and the status of the heaters and air blowers mounted adjacent to the target. When the target functions as a gas target the generated heat from the beam is removed from the target by air blowers and the cooling section. The rupture point of the target window is increased by a factor of two or more by one thin wire or two parallel thin wires welded at the end of a small hollow tube held against the target window. One or two coils are used to produce a uniform magnetic filed along the beam path for preventing the density depression in the target and suppression of other instabilities that can develop in a high power target.

BRIEF DESCRIPTION OF THE DRAWINGS

The invention, in accordance with preferred and exemplary, embodiments together with further objects and advantages thereof, is more particularly described in the following detailed description taken in conjunction with the accompanying drawings in which.

DETAILED DESCRIPTION OF THE INVENTION

Figure 1:
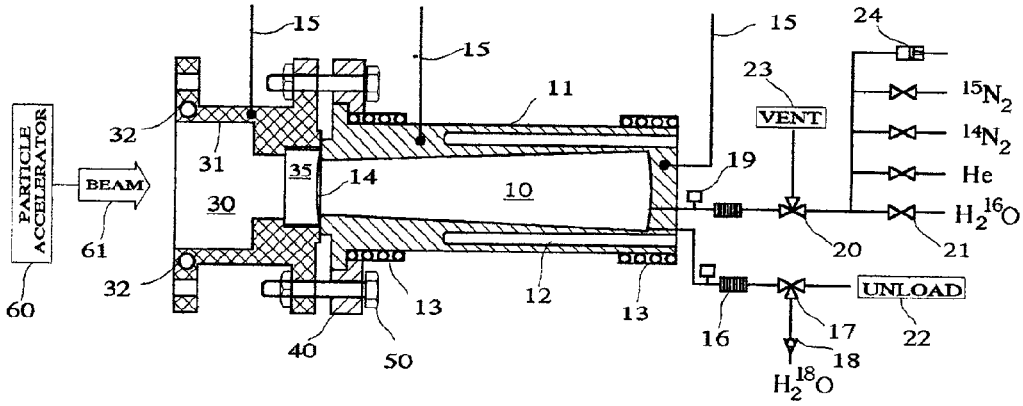
FIG. 1 is partly cross sectional view showing the target and cooling section which is bolted to the target by an auxiliary flange and partly schematic view showing the accelerator, direction of the beam, loading and unloading lines in accordance with an exemplary embodiment of the present invention.
Figure 2:
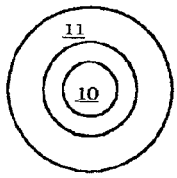
FIG. 2 is the front view of the target.
Figure 3:
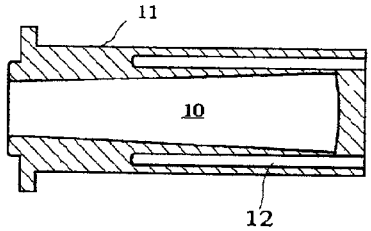
FIG. 3 is a cross sectional view of the target showing the target body, the target cavity for confining target material for irradiation, and bores for housing cartridge heaters.
Figure 4:
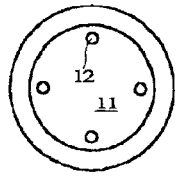
FIG. 4 is a back view of the target body.
Figure 5:
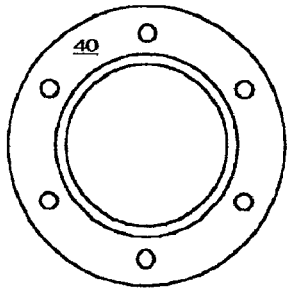
FIG. 5 shows the front view of the auxiliary flange which is used to bolt the target to the cooling section.
Figure 6:
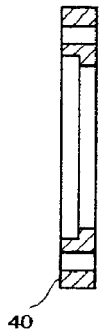
FIG. 6 is the sectional view of FIG. 5.

One of the objects of the present invention is to reduce the consumption of Oxygen-18 water for production of a given amount of Fluorine-18 isotope to about one tenth of its present consumption in a conventional water target. To explain how this is accomplished and also for the sake of clarity and definition as well as describing the other objects of the present invention without any ambiguity we make the following assumptions. We assume that the beam of charged particles that is used to bombard a material sample are protons and the beam energy is 11 MeV. The discussions and conclusions that follows are not, of course, limited to this particular type of beam or its energy. Some terminology that are used in this section are as follows. The term "sample" refers to the material sample bombarded by the beam to produce a given isotope. The term "irradiation" refers to bombarding the material sample by the beam. The word "target" refers mostly to the target body plus the material sample confined in the target body. In the following, the remaining objects of the present invention is briefly described.

The other object of the invention is to replace the four dedicated targets that are presently used to produce the four isotopes of PET with one single target. That is, to demonstrate that the target of the present invention can be used to produce all four isotopes that are commonly used for PET. When the target functions as a water target the water sample (Oxygen-18, or Oxygen-16 water) is converted to steam before irradiation and remains as steam during the irradiation. When the target functions as a gas target it functions as a conventional gas target. The gas sample (Nitrogen-15, and Nitrogen-14) remains in gaseous form during the irradiation.

Further object of the present invention is to increase the rupture point of the target window (the thin metallic foil which is used to seal the target sample) by at least a factor of two. As the beam power increases the target pressure rises due to heating of the target sample. By increasing the rupture point of the target window the target can accept more beam. Present accelerators produces more beam current than a target can take. Increasing the rupture point of the target window allows the target to accept more beam which in turn contributes to more efficient use of the available resources.

Still further object of the present invention is to suppress the density depression that is known to occur along the beam path in a gas target or, as the present invention deals with, in a steam target. The density depression is attributed to the heating of the material sample. However, a more plausible reason for this will be presented in this section followed by the solution for preventing the occurrence of the density depression. The density depression causes the beam to strike the back of the target which is not a desirable situation and can cause further instabilities to grow in the target.

Having stated the main objects of the present invention, the outline for this section is as follows. First, the range of the target length for a steam target is calculated. This is done by selecting convenient and plausible values for a steam target as a function of steam pressure, temperature and density during the irradiation. From the calculated range the target length is determined by requiring that the target should also function as a gas target.

An 11 MeV proton has a range of about 1.2 mm in water. That is, an 11 MeV proton travels about 1.2 mm in water before losing all its energy. As noted in this section, in the present target the loaded water is converted to steam before turning on the beam and remains as steam during the bombardment. Therefore, we need to calculate the range of an 11 MeV proton in a steam target. To make a steam target range thick we require that the incoming beam encounters the same amount of water molecules as they would in a 1.2 mm thick water. From this requirement we obtain $$R(\text{steam})=0.12\rho(\text{steam})$$

where R(steam) is the range of 11 MeV proton in cm in steam and $\rho$(steam) is the density of steam in gram/cm$^3$. As expected, R(steam) depends on the density of the steam. If we require that the beam bombarding the steam lose all of its energy in the target then R(steam) is also equal to the minimum target length. We use this requirement to calculate the minimum target length. Denoting the target length by L and expressing the value of L in cm we $$L\ (\text{in cm}) \geqq 0.12/\rho(\text{steam in gram/cm}^3)$$

Since a target window will eventually rupture as the target pressure increases, the target pressure during the bombardment must be kept reasonably below the rupture point of the target window. On the other hand, the target density depends on the target pressure. Therefore, it is the value of the target pressure that determines the target density to be used in the above relation. The target length is calculated from the above relation based on the target density.

We assume that during bombardment the target is composed of a mixture of steam and water. This is the definition of saturated steam. As explained shortly, the target is designed so that this assumption remains true. Subsequently, all calculations for determining the target pressure, target density and target temperature will be carried out for a saturated steam. For saturated steam the pressure, density, and temperature are not independent quantities. For example, given the pressure of a saturated steam, the temperature and the density can be determined from look up tables available in literature. Table I shows several examples. The first item in each row of Table I is chosen value for the pressure of a saturated steam. The second and third items are the derived temperature and density for this particular pressure. The fourth item of this table gives the minimum target length for an 11 MeV beam of proton using $L(\text{in cm})=0.12/\rho(\text{steam in gram/cm}^3)$. The last column contains comments whether the parameter in a given row are suitable for a target.

TABLE I

Target Length for Selected Combination of Saturated Steam Parameters

| Pressure (psi) | Temperature (Celsius) | Density (gram/cm$^3$) | Target Length cm | Comments |
|---|---|---|---|---|
| 100 | 164 | $0.6 \times 10^{-3}$ | 33 | Target Length too long |
| 330 | 229 | $1.21 \times 10^{-2}$ | 10 | Reasonable |
| 500 | 241 | $1.73 \times 10^{-2}$ | 7 | Reasonable |
| 800 | 270 | $2.8 \times 10^{-2}$ | 4.2 | Reasonable |
| 1450 | 310 | $5.5 \times 10^{-2}$ | 2.2 | Pressure too high |

Considering the rupture point of a typical target which will be presented shortly, we observe from the above table that when the pressure is within several hundred psi (pound per square inch) both the target length and temperature are within acceptable ranges. Therefore, the target length can be chosen to be somewhere between 4 cm to slightly more than 10 cm. To select the final value of the target length we include the additional constrain that the target should also function as a gas target. Similar to a steam target, the pressure in the gas target must be high enough to make the target range thick and should remain comfortably below the rupture point of the target window. We do not have to do additional calculations for a gas target. Instead, we use the dimensions of a dedicated gas target which are commonly used in PET. A typical gas target for an 11 MeV energy proton is about 10 cm long. This length falls within the range of a steam target length. Therefore, the target length of the present invention for a proton beam of 11 MeV energy is about 10 cm long. As seen from Table I, when the target operates as a water target the target temperature during the bombardment must be kept above 299° C. to assure that target remains range thick. The upper value of the target temperature is determined by the rupture point of the target window. This issue and the pressure rise due to heating will be discussed after introducing the target hardware.

FIG. 1 shows sectional view of the entire target and the peripheral devices. Target body 11 comprises of slanted cavity 10 to confine the material sample, four blind holes 12 on the back to house up to four heater cartridges, and windings 13 for generating magnetic field in cavity 10. The material samples being gas or steam are confined in cavity 10 by metallic foil 14 which is also called the target window. Foil 14 is held very tightly between target body 11 and cooling flange 31 by screws and nuts 50. It was determined experimentally that this method of sealing the target sample in which metallic foil 14 is tightly sandwiched between target body 11 and cooling flange 31 is very secure and never fails to seal the target sample at high pressure and temperature. Note that this method of sealing in which all contributing parts are metallic is also immune to impurity and contamination of isotopes. This is not true, however, in a conventional method sealing in which an o-ring is used to seal the target.

Figure 7:
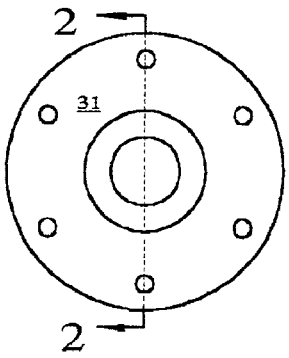
FIG. 7 is the front view of the cooling section.
Figure 8:
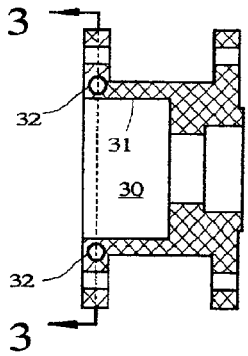
FIG. 8 is a sectional view of the cooling section taken along plane 2—2 of FIG. 6.
Figure 9:
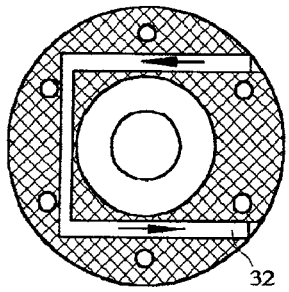
FIG. 9 is a sectional view of the cooling section taken along plane 3—3 of FIG. 7.
Figure 10:
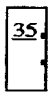
FIG. 10 shows a side view of the target window support which comprises of hollow metallic tube and two thin wires hard soldered at one end of the tube.
Figure 11:
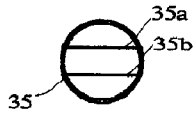
FIG. 11 is a front view of the target window support.

Referring to FIG. 1, thermocouples 15 are used to measure the temperature at selected points. The output of these thermocouples are connected to a microprocessor which monitors the temperature of these points. The microprocessor itself is not shown in FIG. 1. Cooling flange 31 in FIG. 1 has coolant pathways which are shown in more details in FIGS. 7–9. The coolant flow is controlled by the microprocessor by using the output of thermocouples 15 as feedback. The front end of cooling flange 31 is adapted to interface the beam tube of the accelerator. Target-window-support 35 is housed in cooling flange 31. It comprises of a hollow thin tube and one thin wire (bisecting the circular area of the tube end) or two parallel thin wires (dividing the area to three equal parts) which are hard soldered at one end of the tube as shown in FIGS. 10, and 11. In its assembled location the wire side of target-window-support 35 faces target window 14. As the pressure in the target increases target window 14 tends to bow out which then comes in contact with the thin wire of target-window-support, 35*a* and 35*b* of FIG. 11. This causes the rupture point of target window 14 to increase by about a factor of 2 in case of one wire and by higher value in case of two wires. A sample of the data is presented in following.

Havar is a commercially available target window which is an alloy of mainly steel, and nickel. The measured results to be described here were taken from a setup similar to FIG. 1 but without the beam. The target was loaded with a few cc of Oxygen-16 water and the heater were turned on to measure the rupture point of a Havar window as a function of steam temperature. The pressure were also measured directly and or indirectly from the temperature. With a target entrance of 8mm and without the target window support a one mil Havar ruptures at around 850 psi. Using the target-window-support that uses one thin wire (about 0.5 mm thick) the rupture point of the one mil Havar was increased to around 1700 psi.

Referring to FIG. 1, two-way valves 21, three-way valves 20, and check-valve 18 are used for loading a given sample an unloading the sample after irradiation. The samples to be loaded for irradiation are Oxygen-18 water ($H_2\ ^{18}O$), Oxygen-16 water ($H_2\ ^{16}O$), Nitrogen-14 ($^{14}N_2$), and Nitrogen-15 ($^{14}N_2$) which are used to produce Fluorine-18 ($^{18}F$), Nitrogen-13 ($^{13}N$), Carbon-11($^{11}C$), and Oxygen-15 ($^{15}O$), respectively. Insulators 16 electrically insulate the target from the loading and unloading lines. This allows monitoring the bombarding beam current reaching the target. Heat sinks 19 causes a temperature gradient between the target section and the load/unload lines for protecting the lines from overheating and for preventing insulators 16 to melt.

Coils 13 in FIG. 1 are used to generate a magnetic field parallel to the axis of the target body. The function of the magnetic field is to prevent the density depression along the beam path in target body 10. Further function of the magnetic field is to prevent further instabilities that can occur along the beam path. It is well known that as the beam power increases all gas targets develop a density depression due to heating of the gas by the bombarding beam. The actual reasons for the density depression are as follows. The incoming beam loses almost all of its energy by ionizing the gas or the steam along its path. This result information of a plasma (ionized gas made of electrons and ions) column along the beam path. The electrons of the plasma column which are more mobile than ions leave the plasma column. Upon their departure an electrostatic field is formed which pushed the ions out of the plasma column resulting in the density depression. In the presence of the magnetic field the electrons can only move along the magnetic field lines. That is, they can only move along the beam path. Subsequently, the electrostatic field noted above will not be formed. The ions remain along the beam path and the density depression cannot develop. Also, associated with the interaction of the beam and the plasma that forms along the beam path are instabilities that can only have harmful effects. The other function of the magnetic is to suppress or retard the growth of these instabilities.

In the following the major steps for the operation of the target to produce Fluorine-18 ($^{18}F$) from a beam of 11 MeV proton irradiating Oxygen-18 water is described. Before the injection of Oxygen-18 water cavity 10 is filled with He gas at about atmospheric pressure. This is done by using a vacuum pump that is connected to VENT 23. The pump is not shown in FIG. 1. The next steps is to inject about 150 micro liter Oxygen-18 water in the target, cavity 10. The 150 micro liter stated here is for a target with an average diameter of 1 cm. After the injection of the water the heaters are turned on to convert the water into a saturated steam of a preselected temperature. This value for a target length of 10 cm and 11 MeV proton beam, as seen from the Table I, is around 230° C. When the target body reaches this predetermined temperature the beam is turned on. The microprocessor attempts to keep the target temperature between 230–240° C. Depending on the rupture point of the target window, the temperature can momentarily increase to as much as 300° C. without rupturing the target window. At the end of the bombardment the heater is turned off and the and the target is cooled to reach close to room temperature. The generated Flourine-18 which is now aqueous phase is unloaded using He as the push gas. The target is rinsed by Oxygen-16 water once or twice to collect the remaining residual Fourine-18 isotope.

In a target that is designed to operate with the above parameters and for a given beam power, the dimensions of the cooling flange 31 and the exact location of the coolant pathways should be chosen in order to keep the target temperature at a predetermined valuve. This is not a requirement rather for convenience. In that case the microprocessor remains less active. The design parameters show in FIG. 1 is for a target length of 10 cm and a 40 mA beam of proton at 11 MeV. Based on these calculations, which are not presented here, the entrance of the target should remain around 230° C.

To operate the target as a gas target the heaters remain off and coolant flow during the entire operation. The microprocessor keeps the air blowers which are mounted around the target, the blowers are not shown in FIG. 1, on. If the target temperature (or equivalently the pressure) reaches close to the rupture point of the target window the microprocessor alerts the operator to reduce the beam power. This mode of operation, that is when the sample to be irradiated is a gas, is similar to the operation of a conventional gas target.

One of the significant issues is to choose a suitable material for the target body 11. During the irradiation the generated Fluorine-18 isotope which is highly reactive in is under very high pressure and temperature. Under these conditions a potential target body should neither adsorb the generated isotope to the extent of making unloading impractical nor form non-reactive metal compounds. To select a suitable metal for the target body the following experiment were conducted. In an experimental setup similar to FIG. 1 and without using a beam about 2 mCi of aqueous Fluorine-18 in about 2 cc of water was loaded in the target made from the type of metal to be tested. In a typical experiment, after loading the sample the heaters were turned on to convert the loaded sample to predetermined temperature and keep it at that temperature for about 30 minutes. The sample was unloaded after this period and the amount of unloaded fluorine-18 was measured and the measured value was corrected due to decaying. Among the several prospective metallic target bodies that were tested the most suitable ones were Silver, Nickel, and Steel. With these target bodies almost the entire loaded Fluorine-18 (decay corrected) could be unloaded. The loading and unloading lines were the commercially available stainless steel tubings which did not show any sign of absorbing Fluorine-18 isotope under high pressure temperature.

In the following, by using the results of this section, a summary of the objects of the present inventions will be followed by additional substantiation when needed. One of the key objects of the present invention is to reduce the consumption of the Oxygen-18 water as compared to a conventional water target. Let's compare the consumption of Oxygen-18 water in the present target with a conventional water target. Since the range of an 11MeV proton in water is about 1.2 mm the length of the water column as seen by the beam in a conventional water target should not be much larger than 1.2 mm. However, this length which is also called the target depth is around 1.2 cm for a moderate beam power and around 1.2 cm for 40 mA beam. That, is the target depth is about ten times the range of proton in water for a moderate beam power and its larger than ten times for a high power beam. The reason for this is because of formation of bubbles or voids due to boiling of water, which was explained in the BACKGROUND section of this application. In the present invention, however, the material sample is already in the form of steam. Compared to the water target, the material sample of the present target is already made of a bubble, a giant bubble that cannot change phase as the beam current increases. Subsequently, the length of the steam column as seen be the beam should be such that the beam encounters the same amount of water molecules as it would in a 1.2 mm long water. The obvious conclusion of comparing this 1.2 cm is that a water target of 1.2 cm long uses ten times more water that the present target.

The other objects of the present invention is to replace the four dedicated targets of PET with one single target. It was shown in this section that the steam target of the present invention which replaces the conventional water targets is also quite suitable to operate as a gas target.

Further objects of the present invention is to reduce the density depression that occurs in a gas or a steam target. This was achieved by creating a magnetic field in the target with field lines along the beam path.

What is claimed is:

1. A target system for confining a material sample to be irradiated with a beam of charged particles for producing a radioisotope, the system comprising:

a body having a substantially enclosed chamber for confining a material sample to be irradiated with a beam of charged particles;

means mounted within the body for heating, when desired, the material sample to an elevated temperature;

means associated with the body for preventing the body from exceeding a preselected temperature.

2. The target system as defined in claim 1 wherein the body includes an entrance end through which charged particles are permitted to enter the chamber, and the chamber has a cross section whose size increases as a path is traced along the chamber from entrance end.

3. The target system as defined in claim 2 wherein the chamber interior is conical-shaped with the smaller end of the chamber interior corresponding with the entrance end of the body.

4. The target system as defined in claim 1 wherein the body defines at least one opening having walls which are spaced from the walls of the chamber, and the heating means includes an electric heating element positioned within the at least one opening for generating heat with which the temperature of the material sample confined within the chamber can be raised.

5. The target system as defined in claim 4 wherein the associated means includes means for conducting heat from the body when the body reaches a preselected temperature.

6. The target system as defined in claim 5 wherein the body includes at least one fluid-conducting passageway, and the means for conducting heat from the body includes means for directing a cooling fluid through the at least one fluid-conducting passageway for purposes of cooling the body, and the associated means includes means for monitoring the temperature of the body.

7. The target system as defined in claim 6 wherein the temperature monitoring means is connected to the heat conducting means so that when the temperature of the body reaches the preselected temperature, the operation of the heat conducting means is initiated.

8. The target system as defined in claim 1 wherein the body includes an entrance end through which charged particles are permitted to enter the chamber, and the system includes a thin foil positioned across the entrance end through which the charged particles must pass before they enter the chamber, and at least one thin wire positioned across so as to span a side surface of the foil for providing structural support to the foil during operation of the system to enable the foil to withstand an appreciable pressure differential which can be developed on opposite side surfaces of the foil during use of the system.

9. A target system for confining a material sample to be irradiated with a beam of charged particles for producing a radioisotope, the system comprising:

a body having a substantially enclosed chamber for confining a material sample to be irradiated with a beam of charged particles and wherein the enclosed chamber has an entrance end through which charged particles are permitted to enter the chamber and is elongated in shape as a path is traced therealong from the entrance end and has a longitudinal axis; and means for generating a magnetic field parallel to the longitudinal axis of the chamber.

10. The target system as defined in claim 9 wherein the means for generating a magnetic field includes at least one electrically-conducting coil encircling the elongated chamber.

11. The target system as defined in claim 9 wherein the chamber has an interior which is conical-shaped with the smaller end of the interior corresponding with the entrance end of the body.

12. The target system as defined in claim 9 further comprising:

a thin foil positioned across the entrance end through which the charged particles must pass before they enter the chamber, and at least one thin wire positioned across so as to span a surface of the foil for providing structural support to the foil during operation of the system to enable the foil to withstand an appreciable pressure differential which can be developed on the opposite side surfaces of the foil during use of the system.

13. The target system for confining a material sample to be irradiated with a beam of charged particles for producing a radioisotope, the system comprising:

a first body having a substantially enclosed chamber for confining a material sample to be irradiated with a beam of charged particles and wherein the enclosed chamber includes an entrance end through which charged particles are permitted to enter the chamber; and means mounted within the first body for heating, when desired, the material sample to an elevated temperature;

means associated with the first body for preventing the body from exceeding a preselected temperature wherein the associated means includes a second body attachable to the first body adjacent the entrance end of the chamber and including at least one fluid-conducting passageway, and the associated means further includes means for directing a cooling fluid through the at least one fluid-conducting passageway for purposes of cooling the first body.

14. The target system as defined in claim 13 further including means for monitoring the temperature of the first body, and the temperature monitoring means is connected to the associated means so that when the temperature of the first body reaches the preselected temperature, the operation of the associated mean is initiated.

15. The target system as defined in claim 14 further comprising:

a thin foil positioned across the entrance end through which the charged particles must pass before they enter the chamber, and at least one thin wire positioned across so as to span a side surface of the foil for providing structural support to the foil during operation of the system to enable the foil to withstand an appreciable pressure differential which can be developed on the opposite side surfaces of the foil during use of the system.

* * * * *